United States Patent [19]

Chia et al.

[11] 4,216,031

[45] * Aug. 5, 1980

[54] ALUMINUM NICKEL BASE ALLOY ELECTRICAL CONDUCTOR AND METHOD THEREFOR

[75] Inventors: E. Henry Chia; Roger J. Schoerner, both of Carrollton, Ga.

[73] Assignee: Southwire Company, Carrollton, Ga.

[ * ] Notice: The portion of the term of this patent subsequent to Jul. 6, 1993, has been disclaimed.

[21] Appl. No.: 871,617

[22] Filed: Jan. 23, 1978

Related U.S. Application Data

[60] Continuation-in-part of Ser. No. 702,423, Jul. 6, 1976, abandoned, which is a continuation-in-part of Ser. No. 444,497, Feb. 21, 1974, Pat. No. 3,967,983, which is a division of Ser. No. 160,189, Jul. 6, 1971, abandoned, which is a continuation-in-part of Ser. No. 147,196, May 26, 1971, abandoned.

[51] Int. Cl.[2] ..... C22F 1/04

[52] U.S. Cl. ..... 148/2; 75/138; 148/11.5 A; 148/32

[58] Field of Search ..... 75/138; 148/2, 11.5 A, 148/32, 32.5

[56] References Cited

U.S. PATENT DOCUMENTS

| | | | |
|---|---|---|---|
| 3,697,260 | 10/1972 | Hunsicker | 148/11.5 A |
| 3,967,983 | 7/1976 | Chia et al. | 148/2 |

*Primary Examiner*—R. Dean

*Attorney, Agent, or Firm*—Herbert M. Hanegan; Stanley L. Tate; Robert S. Linne

[57] ABSTRACT

Improved aluminum alloy electrical conductors and method for making same are disclosed. The alloy contains from about 0.55 to about 0.65 weight percent nickel, the remainder aluminum with associated trace elements including no more than 0.15 weight percent iron, no more than 0.001 weight percent magnesium and no more than 0.05 weight percent copper.

7 Claims, No Drawings

ALUMINUM NICKEL BASE ALLOY ELECTRICAL CONDUCTOR AND METHOD THEREFOR

CROSS-REFERENCE TO RELATED APPLICATIONS

This application is a continuation-in-part of copending application Ser. No. 702,423, filed July 6, 1976, now abandoned, which was a continuation-in-part of application Ser. No. 444,497, filed Feb. 21, 1974, now U.S. Pat. No. 3,967,983, which was a division of application Ser. No. 160,189, filed July 6, 1971, which in turn was a continuation-in-part of application Ser. No. 147,196, filed May 26, 1971, both now abandoned.

DESCRIPTION OF THE PREFERRED EMBODIMENTS

The present invention concerns an aluminum base alloy especially suited for producing high strength lightweight electrical conductors including wire, rod and other such articles of manufacture. The present alloy is particularly well suited for use as wire, rod, cable, bus bar, tube connector, terminations, receptacle plugs, or electrical contact devices for conducting electricity.

Aluminum base alloys are finding wider acceptance in the marketplace of today because of their light weight and low cost. One area where aluminum alloys have found increasing acceptance is in the replacement of copper in the manufacture of electrically conductive wire. Conventional electrically conductive aluminum alloy wire (referred to as EC) contains a substantial amount of pure aluminum and trace amounts of impurities such as silicon, vanadium , iron, copper, manganese, magnesium, zinc, boron and titanium.

Even though desirable in terms of weight and cost, aluminum alloys have received far less than complete acceptance in the electrical conductor marketplace. One of the chief reasons for the lack of complete acceptance is the range of physical properties available with conventional EC aluminum alloy conductors. If the physical properties, such as thermal stability, tensile strength, percent elongation, ductility and yield strength, could be improved significantly without substantially lessening the electrical conductivity of the finished product, a very desirable improvement would be achieved. It is accepted, however, that addition of alloying elements, as in other aluminum alloys, reduced conductivity while improving the physical properties. Consequently, only those additions of elements which improve physical properties without substantially lessening conductivity will yield an acceptable and useful product.

It is an object of the present invention, therefore, to provide a new aluminum alloy electrical conductor which combined improved physical properties with acceptable electrical conductivity. These and other objects, features and advantages of the present invention will be apparent from a consideration of the following detailed description of an embodiment of the invention.

In accordance with the present invention, the aluminum base alloy conductor is prepared by mixing nickel and optionally other alloying elements with aluminum in a furnace to obtain a melt having requisite percentages of elements. It has been found that suitable results are obtained with nickel present in a weight percentages of from about 0.55 percent to about 0.65 percent.

The aluminum content of the present alloy may vary from about 97.35 percent to about 99.45 percent by weight with superior results being obtained when the aluminum content varies between about 97.90 percent and about 99.40 percent by weight. Particularly superior and preferred results are obtained when the aluminum content is from about 98.15 percent to about 99.35 percent by weight. Since the percentages for maximum and minimum aluminum do not correspond with the total of maximums and minimums for alloying elements, it should be apparent that suitable results are not obtained if the maximum percentages for all alloying elements are employed. If commercial aluminum is employed in preparing the present melt, it is preferred that the aluminum, prior to adding to the melt in the furnaces, contain no more than about 0.10 percent total of trace impurities.

It has been further determined in accordance with this invention that the iron, copper and magnesium content must be very closely controlled in order to permit effective continuous processing of the product. Thus, not more than 0.15 weight percent iron, 0.001 weight percent magnesium, and 0.05 weight percent copper can be tolerated. Although each of these metals is an effective hardening element, if more than 0.05 percent copper, for example, is present in the alloy of this invention, it will form extremely hard cuprous oxide particles that will result in splitting and cracking when the continuously processed product is rolled and cold drawn. Since a conventionally processed product can be homogenized prior to rolling to refine the grain structure, the copper content thereof need not be so closely controlled. However, when the product is continuously processed in accordance with the instant invention, the cast bar is substantially immediately rolled in the as-cast condition and thus does not have the benefit of an homogenizing step. Consequently, the content of the aforementioned elements must be closely controlled to avoid the brittleness which leads to splitting and cracking of the bar when processed according to the method of this invention.

Optionally the present alloy may contain an additional alloying element or group of alloying elements. The total concentration of the optional alloying elements may be up to about 2.00 percent by weight; preferably from about 0.10 percent to about 1.50 percent by weight is employed. Particularly superior and preferred results are obtained when from 0.10 percent to about 1.00 percent by weight of total additional alloying elements is employed.

Additional alloying elements include the following:

| ADDITIONAL ALLOYING ELEMENTS | | |
|---|---|---|
| Silicon | Scandium | Vanadium |
| Zirconium | Thorium | Rhenium |
| Cerium | Tin | Dysprosium |
| Niobium | Molybdenum | Terbium |
| Hafnium | Zinc | Erbium |
| Lanthanum | Tungsten | Neodymium |
| Tantalum | Chromium | Indium |
| Cesium | Bismuth | Boron |
| Titanium | Antimony | Thallium |
| Yttrium | Carbon | Rubidium |

Superior results are obtained with the following additional alloying elements in the percentages, by weight, as shown:

| PREFERRED ADDITIONAL ALLOYING ELEMENTS | |
|---|---|
| Silicon | 0.05 to 1.00% |
| Zirconium | 0.01 to 1.00% |
| Niobium | 0.01 to 2.00% |
| Tantalum | 0.01 to 2.00% |
| Yttrium | 0.01 to 1.00% |
| Scandium | 0.01 to 1.00% |
| Thorium | 0.01 to 1.00% |
| Rare Earth Metals | 0.01 to 2.00% |
| Carbon | 0.01 to 1.00% |

The rare earth metals may be present either individually within the percentage range stated or as a partial or total group, the total percentage of the group being within the percentage range stated previously.

It should be understood that the additional alloying elements may be present either individually or as a group of two or more of the elements. It sould be understood, however, that if two or more of the additional alloying elements are employed, the total concentration of additional alloying elements should not exceed about 2.00 percent by weight.

If more than trace amounts of titanium are present, suitable amounts of boron must be added to tie-up the excess titanium to prevent the same from reducing the electrical conductivity below acceptable levels.

After preparing the melt, the aluminum alloy is preferably continuously cast into a continuous bar by a continuous casting machine and then, substantially immediately thereafter, hot-worked in a rolling mill to yield a continuous aluminum alloy rod.

One example of a continuous casting and rolling operation capable of producing continuous rod as specified in this application is contained in the following paragraphs. It should be understood that other methods of preparation may be employed to obtain suitable results but that preferable results are obtained with continuous processing. Such other methods include conventional extrusion and hydrostatic extrusion to obtain rod or wire directly, sintering an aluminum alloy powder to obtain rod or wire directly, casting rod or wire directly from a molten aluminum alloy, and conventional casting of aluminum alloy billets which are subsequently hot-worked to rod and drawn with intermediate anneals into wire.

CONTINUOUS CASTING AND ROLLING OPERATION

A continuous casting machine serves as a means for solidifying the molten aluminum alloy metal to provide a cast bar that is conveyed in substantially the condition in which it solidifed from the continuous casting machine to the rolling mill, which serves as a means for hot-forming the cast bar into rod or another hot-formed product in a manner which imparts substantial movement to the cast bar along a plurality of angularly disposed axes.

The continuous casting machine is of conventional casting wheel type having a casting wheel with a casting groove in its periphery which is partially closed by an endless belt supported by the casting wheel and an idler pulley. The casting wheel and the endless belt cooperate to provide a mold into one end of which molten metal is poured to solidify and from the other end of which the cast bar is emitted in substantially that condition in which it solidified.

The rolling mill is of conventional type having a plurality of roll stands arranged to hot-form the cast bar by a series of deformations. The continuous casting machine and the rolling mill are positioned relative to each other so that the cast bar enters the rolling mill substantially immediately after solidification and is substantially that condition in which it solidified. In this condition, the cast bar is at a hot-forming temperature within the range of temperatures for hot-forming the cast bar at the initiation of hot-forming without heating between the casting machine and the rolling mill. In the event that it is desired to closely control the hot-forming temperature of the cast bar within the conventional range of hot-forming temperatures, means for adjusting the temperature of the cast bar may be placed between the continuous casting machine and the rolling mill without departing from the inventive concept disclosed herein.

The roll stands each include a plurality of rolls which engage the cast bar. The rolls of each roll stand may be two or more in number and arranged diametrically opposite from one another or arranged at equally spaced positions about the axis of movement of the cast bar through the rolling mill. The rolls of each roll stand of the rolling mill are rotated at a predetermined speed by a power means such as one or more electric motors and the casting wheel is rotated at a speed generally determined by its operating characteristics. The rolling mill serves to hot-form the cast bar into a rod of a cross-sectional area substantially less than that of the cast bar as it enters the rolling mill.

The peripheral surfaces of the rolls of adjacent roll stands in the rolling mill change in configuration; that is, the cast bar is engaged by the rolls of successive roll stands with surfaces of varying configuration, and from different directions. The varying surface engagement of the cast bar in the roll stands functions to knead or shape the metal in the cast bar in such a manner that it is worked at each roll stand and also to simultaneously reduce and change the cross-sectional area of the cast bar into that of the rod.

As each roll stand engages the cast bar, it is desirable that the cast bar be received with sufficient volume per unit of time at the roll stand for the cast bar to generally fill the space defined by the rolls of the roll stand so that the rolls will be effective to work this metal in the cast bar. However, it is also desirable that the space defined by the rolls of each roll stand not be overfilled so that the cast bar will not be forced into the gaps between the rolls. Thus, it is desirable that the rod be fed toward each roll stand at a volume per unit of time which is sufficient to fill, but not overfill the space defined by the rolls of the roll stand.

As the cast bar is received from the continuous casting machine, it usually has one large flat surface corresponding to the surface of the endless band and inwardly tapered side surfaces corresponding to the shape of the groove in the cast wheel. As the cast bar is compressed by the rolls of the roll stands, the cast bar is deformed so that it generally takes the cross-sectional shape defined by the adjacent peripheries of the rolls of each roll stand.

Thus, it will be understood that with this apparatus, cast aluminum alloy rod of an infinite number of different lengths is prepared by simultaneous casting of the molten aluminum alloy and hot-forming or rolling the cast aluminum bar. The continuous rod has a minimum electrical conductivity of 57 percent IACS and may be used in conducting electricity or it may be drawn to wire of a smaller cross-sectional diameter.

To produce wire of various gauges, the continuous rod produced by the casting and rolling operation is processed in a reduction operation. The unannealed rod (i.e., as rolled to f temper) is cold-drawn through a series of progressively constricted dies, without intermediate anneals, to form a continuous wire of desired diameter. It has been found that the elimination of intermediate anneals is preferable during the processing of the rod and improves the physical properties of the wire. Processing with intermediate anneals is acceptable when the requirements for physical properties of the wire permit reduced values. The conductivity of the hard-drawn wire is at least 58 percent IACS. If greater conductivity or increased elongation is desired, the wire may be annealed or partially annealed after the desired wire size is obtained and cooled. Fully annealed wire has a conductivity of at least 59 percent IACS. At the conclusion of the drawing operation and optional annealing operation, it is found that the alloy wire has the properties of improved tensile strength and yield strength together with improved thermal stability, percent ultimate elongation and increased ductility and fatigue resistance as specified previously in this application. The annealing operation may be continuous as in resistance annealing, induction annealing, convection annealing by continuous furnaces or radiation annealing by continuous furnaces, or, preferably, may be batch annealed in a batch furnace. When continuously annealing, temperatures of about 450° F. to about 1200° F. may be employed with annealing times of about five minutes to about 1/10,000 of a minute. Generally, however, continuous annealing temperatures and times may be adjusted to meet the requirements of the particular overall processing operation so long as the desired physical properties are achieved. In a batch annealing operation, a temperature of approximately 400° F. to about 750° F. is employed with residence times of about thirty (30) minutes to about twenty-four (24) hours. As mentioned with respect to continuous annealing, in batch annealing the times and temperatures may be varied to suit the overall process so long as the desired physical properties are obtained.

It has been found that the properties of a Number 10 gauge (American wire gauge) fully annealed soft wire of the present alloy vary between the following figures:

| Conductivity | Tensile Strength, psi. | % Elongation | Yield Strength, psi. |
|---|---|---|---|
| 58%-63+% | 12,000-24,000 | 12%-30% | 8,000-18,000 |

A more complete understanding of the invention will be obtained from the following examples:

EXAMPLE 1

Various melts were prepared by adding the required amount of alloying elements to 1816 grams of molten aluminum, containing less than 0.10% trace element impurities, to achieve a percentage concentration of elements as shown in the accompanying table; the remainder being aluminum. Graphite crucibles were used except in those cases where the alloying elements were known carbide formers, in which cases aluminum oxide crucibles were used. The melts were held for sufficient times and at sufficient temperatures to allow complete solubility of the alloying elements with the base aluminum. An argon atmosphere was provided over the melt to prevent oxidation. Each melt was continuously cast on a continuous casting machine and immediately hot-rolled through a rolling mill to ⅜ inch continuous rod. Wire was then drawn and annealed from the rod (soft [annealed] wire from hard [as rolled] rod). The final wire diameter obtained as 0.1019 inches, 10 gauge AWG.

The types of alloys employed and the results of the tests performed thereon are as follows:

TABLE 1

| Ni | Mg | UTS | % Elong. | % IACS |
|---|---|---|---|---|
| .60 | | 18,800 | 22.2 | 60.70 |
| .80 | | 19,500 | 25.0 | 59.96 |
| .80 | .10 | 19,200 | 23.9 | 59.32 |

% Elong.=Percent Ultimate Elongation
UTS=Ultimate Tensile Strength
% IACS=Conductivity in Percentage IACS It is understood that alloys 2 and 3 from Table 1, containing 0.80 nickel, are not in accordance with the present invention.

EXAMPLE 2

An additional alloy melt was prepared according to Example 1 having a composition as follows in weight percent:

Nickel—0.60%
Niobium—0.30%
Tantalum—0.18%
Aluminum—Remainder

The melt was processed to a No. 10 gauge soft wire. The physical properties of the wire were as follows:

Ultimate Tensile Strength—17,900
Percent Ultimate Elongation—20%
Conductivity—59.05%

EXAMPLE 3

Various melts were prepared by adding the required amount of alloying elements to 1816 grams of molten aluminum, containing less than 0.10, percent trace element impurities, to achieve a percentage concentration of elements as shown in the accompanying table, the remainder being aluminum. Graphite crucibles were used except in those cases where the alloying elements were known carbide formers, in which cases aluminum oxide crucibles were used. The melts were held for sufficient times and at sufficient temperatures to allow complete solubility of the alloying elements with the base aluminum. An argon atmosphere was provided over the melt to prevent oxidation. Each melt was continuously cast on a continuous casting machine and immediately hot-rolled through a rolling mill to ⅜ inch continuous rod. Wire was then drawn and annealed from the rod which had been annealed for five hours at 650° F. (soft [annealed] wire from soft [annealed] rod). The final wire diameter obtained was 0.1019 inches, 10 gauge AWG.

The types of alloys employed and the results of the tests performed thereon are as follows:

TABLE 2

| Ni | Mg | UTS | % Elong. | % IACS |
|---|---|---|---|---|
| 0.60 | | 16,500 | 24.7 | 61.10 |
| 0.80 | | 16,850 | 26.8 | 60.40 |

TABLE 2-continued

| Ni | Mg | UTS | % Elong. | % IACS |
|---|---|---|---|---|
| 0.80 | 0.10 | 17,100 | 23.4 | 59.90 |

It is noted that only alloy No. 1 from Table 2, containing 0.60 nickel, is in accordance with the present invention. The alloys containing 0.80 percent nickel were of a reduced electrical conductivity.

Through testing and analysis of an alloy containing 0.60 weight percent nickel and the remainder aluminum, it has been found that the present aluminum base alloy after cold working includes an intermetallic compound precipitate. The compound is identified as nickel aluminate ($NiAl_3$). This intermetallic compound is found to be very stable and especially so at high temperatures. The compound also has a low tendency to coalesce during annealing of products formed from the alloy and the compound is generally incoherent with the aluminum matrix. The mechanism of strengthening for this alloy is in part due to the dispersion of the intermetallic compound as a precipitate throughout the aluminum matrix. The precipitate tends to pin dislocation sites which are created during cold working of wire formed from the alloy. Upon examination of the intermetallic compound precipitate in a cold drawn wire, it is found that the precipitates are oriented in the direction of drawing. In addition, it is found that the precipitates can be spherical, rod-like or plate-like in configuration and a majority are less than 2 microns in length and less than ½ micron in width.

Other intermetallic compounds may also be formed depending upon the constituents of the melt and the relative concentrations of the alloying elements. Those intermetallic compounds include the following: $Ni_2Al_3$, MgCoAl, $Co_2Al_9$, $Co_4Al_{13}$, $CeAl_4$, $CeAl_2$, $VAl_{11}$, $VAl_7$, $VAl_6$, $VAl_3$, $VAl_{12}$, $Zr_3Al$, $Zr_2Al$, $LaAl_4$, $LaAl_2$, $Co_2Al_5$.

In order to demonstrate the effect of the elements copper, magnesium and iron on the ductility of the product when continuously processed, various melts were prepared as in EXAMPLE 1 and continuously cast and rolled into ⅜-inch rod. The rod was then hard drawn to a final wire diameter of 0.1019 inches, 10 gauge AWG. The hard drawn wire was then subjected to a "wrap test" in order to determine the brittleness thereof. The "wrap test" comprises wrapping the wire about its own diameter until cracks or breaks appear in the surface thereof. A wire sample that is brittle will, or course, exhibit cracks or breaks after a limited number of turns while a more ductile sample may be turned several times without exhibiting any deleterious effects.

The following table compares a sample wherein the elements copper, magnesium and iron are controlled in accordance with the present invention with various wire samples having increased levels of copper, magnesium and iron:

| Sample | % Ni | % Mg | % Cu | % Fe | No. of Wraps | Remarks |
|---|---|---|---|---|---|---|
| A | 0.6 | 0.001 | 0.04 | 0.15 | 9 | satisfactory ductility - no cracks or breaks |
| B | 0.6 | .2 | .2 | .2 | 5 | poor ductility - cracks appeared in surface |
| C | 0.6 | .5 | .5 | .5 | 2 | brittle - surface breaks |
| D | 0.6 | .5 | .5 | 0.15 | 2 | brittle - cracked open |
| E | 0.6 | 1.0 | 1.0 | <0.25* | 1 | brittle - cracked open |
| F | 0.6 | 1.0 | 1.0 | 1.0 | ½ | very brittle - broke open in less than 1 turn |

*No positive addition of Fe in this sample.
Estimated <0.25 Fe present in commerical Al.

In view of the foregoing, it should be apparent that Sample A, which was manufactured in accordance with the present invention, exhibited a much greater degree of ductility than Samples B–F wherein the amounts of magnesium, copper and iron were greater than the maximum permissible levels of these elements.

For the purpose of clarity, the following terminology used in this application is explained as follows:

Aluminum alloy rod product—A solid product that is long in relation to its cross-section. Rod normally has a cross-section of between three inches and 0.375 inches.

Aluminum alloy wire product—A solid wrought product that is long in relation to its cross-section, which is square or rectangular with sharp or rounded corners or edges, or is round, a regular hexagon or a regular octagon, and whose diameter or greatest perpendicular distance between parallel faces is between 0.374 inches and 0.0031 inches.

While this invention has been described in detail with particular reference to preferred embodiments thereof, it will be understood that variations and modifications can be effected within the spirit and scope of the invention as described hereinbefore and as defined in the appended claims.

We claim:

1. An aluminum base alloy electrical conductor manufactured by continuous casting and then hot-rolling substantially immediately after casting while the cast alloy is in substantially that condition as a cast, said conductor being substantially free of splits and cracks and having a minimum electrical conductivity of 57% IACS, an ultimate tensile strength of at least 12,000 PSI, and a yield strength of at least 8,000 PSI when measured as a fully annealed wire, consisting essentially of from about 0.55 to about 0.65 weight percent nickel, the remainder being aluminum with associated trace elements, said conductor alloy having no more than 0.15 weight percent iron, no more than 0.001 weight percent magnesium and no more than 0.05 weight percent copper to obtain improved ductility over aluminum-nickel alloys having greater percentages of the aforesaid iron, magnesium and copper.

2. An aluminum base alloy electrical conductor according to claim 1 further including at least one additional alloying element selected from the group consisting of the following elements, in a weight percentage as shown for each element, the total not exceeding 2.0%:

Silicon—0.05 to 1.00%
Zirconium—0.01 to 1.00%
Niobium—0.01 to 2.00%
Tantalum—0.01 to 2.00%
Yttrium—0.01 to 1.00%
Scandium—0.01 to 1.00%
Thorium—0.01 to 1.00%
Rare Earth Metals—0.01 to 2.00%.

3. An aluminum base alloy electrical conductor according to claim 1 wherein the conductor is a fully annealed wire which has been cold drawn to finished wire size, without any preliminary or intermediate anneals, prior to the final anneal.

4. Method of preparing an aluminum base alloy electrical conductor having a minimum conductivity of at least 57% IACS comprising the steps of:

A. preparing an alloy consisting essentially of from about 0.55 to about 0.65 weight percent nickel, the remainder aluminum with associated trace elements, said conductor alloy having no more than 0.15 weight percent iron, no more than 0.001 weight percent magnesium and no more than 0.05 weight percent copper to obtain improved ductility over aluminum-nickel alloys having greater percentages of the aforesaid iron, magnesium and copper:

B. casting the alloy in a moving mold formed between a groove in the periphery of a rotating casting wheel and a metal belt lying adjacent said groove for a portion of its length;

C. hot rolling the cast alloy substantially immediately after casting while the cast alloy is in substantially that condition as cast to form a continuous rod;

said aluminum alloy conductor being substantially free of splits and cracks and having a tensile strength of at least 12,000 PSI, and a yield strength of at least 8,000 PSI when measured as a fully annealed wire, and has good thermal stability characteristics.

5. Method according to claim 4, further including the steps of drawing the continuous rod through a series of wire-drawing dies with no preliminary or intermediate anneals to form wire having nickel aluminate inclusions dispersed therein the majority of which are less than 2 microns in length and less than ½ micron in width.

6. Method according to claim 4, wherein the alloy in step A includes at least one additional element from the group consisting of the following elements, in a weight percentage as shown for each element, the total not exceeding 2.0%:

Silicon—0.05 to 1.00%
Zirconium—0.01 to 1.00%
Niobium—0.01 to 2.00%
Tantalum—0.01 to 2.00%
Yttrium—0.01 to 1.00%
Scandium—0.01 to 1.00%
Thorium—0.01 to 1.00%
Rare Earth Metals—0.01 to 2.00%

7. An aluminum base alloy conductor according to claim 1 wherein the magnesium content is 0.001 percent by weight, a copper content is 0.04 percent by weight and the iron content is 0.15 percent by weight.

* * * * *